US011642721B2

(12) United States Patent
Kimura

(10) Patent No.: US 11,642,721 B2
(45) Date of Patent: May 9, 2023

(54) HORIZONTAL CONTINUOUS CASTING APPARATUS AND METHOD FOR MANUFACTURING ALUMINUM ALLOY CAST ROD USING THE SAME

(71) Applicant: SHOWA DENKO K.K., Tokyo (JP)

(72) Inventor: Yoshifumi Kimura, Kitakata (JP)

(73) Assignee: SHOWA DENKO K.K., Tokyo (JP)

( * ) Notice: Subject to any disclaimer, the term of this patent is extended or adjusted under 35 U.S.C. 154(b) by 0 days.

(21) Appl. No.: 17/861,712

(22) Filed: Jul. 11, 2022

(65) Prior Publication Data

US 2023/0023546 A1 Jan. 26, 2023

(30) Foreign Application Priority Data

Jul. 13, 2021 (JP) ..... JP2021-115761

(51) Int. Cl.
*B22D 11/124* (2006.01)
*B22D 11/14* (2006.01)
*B22D 11/00* (2006.01)

(52) U.S. Cl.
CPC ..... *B22D 11/1245* (2013.01); *B22D 11/003* (2013.01); *B22D 11/143* (2013.01)

(58) Field of Classification Search
CPC ..... B22D 11/00; B22D 11/003; B22D 11/124; B22D 11/1245; B22D 11/14; B22D 11/143
USPC ..... 164/485, 443, 490, 440
See application file for complete search history.

(56) References Cited

U.S. PATENT DOCUMENTS 4,601,327 A * 7/1986 Kaneko et al. ..... B22D 11/047 164/466
2006/0090875 A1* 5/2006 Fukuda et al. ..... B22D 11/003 164/472
2006/0180293 A1* 8/2006 Maehara et al. ..... C22C 9/10 164/459
2006/0254679 A1* 11/2006 Odashima et al. ..... C22F 1/04 148/551

FOREIGN PATENT DOCUMENTS

JP 11-170009 A 6/1999

* cited by examiner

*Primary Examiner* — Kevin P Kerns
(74) *Attorney, Agent, or Firm* — Sughrue Mion, PLLC

(57) ABSTRACT

A horizontal continuous casting apparatus includes a fluid supply pipe for supplying a lubricating fluid to the hollow portion of the mold, which is arranged on one end side of the mold; and, a cooling water cavity for accommodating cooling water cooling an inner peripheral surface of the hollow portion of the mold, which is formed outside the inner peripheral surface, wherein the inner peripheral surface and the inner bottom surface of the cooling water cavity facing the inner peripheral surface form parallel surfaces with each other, and a cooling wall of the mold between the inner peripheral surface and the inner bottom surface is formed so that the heat flux value per unit area from the molten aluminum alloy to the cooling water is $10\times10^5$ W/m$^2$ or more.

12 Claims, 2 Drawing Sheets

HORIZONTAL CONTINUOUS CASTING APPARATUS AND METHOD FOR MANUFACTURING ALUMINUM ALLOY CAST ROD USING THE SAME

BACKGROUND OF THE INVENTION

Field of the Invention

The present disclosure relates to a horizontal continuous casting apparatus for continuously casting an aluminum alloy cast rod by supplying molten alloy to a hollow portion of a mold arranged in a horizontal direction, and to a method for manufacturing an aluminum alloy cast rod using the same.

Priority is claimed on Japanese Patent Application No. 2021-115761, filed on Jul. 13, 2021, the content of which is incorporated herein by reference.

Description of Related Art

For example, in recent transportation equipment, aluminum alloy parts have been increasingly adopted in response to the demand for weight reduction. Such aluminum alloy parts are obtained by cutting an aluminum alloy rod into a predetermined length to form a forging material, and molding the forging material into parts by forging. Aluminum alloy rod material is produced by applying plastic processing or heat treatment to a material made by, for example, horizontal continuous casting.

In this horizontal continuous casting, generally, a long ingot of columnar, prismatic or hollow columnar shape is produced from molten metal through the following process. That is, the molten metal entering the molten metal receiving portion for storing the molten metal passes through a molten metal passage made of a refractory material, and then enters the hollow portion of a hollow cylindrical mold installed substantially horizontally, where the molten metal is forcibly cooled to form a solidified shell on the outer surface of the molten metal body. Further, a coolant such as water is directly radiated to the ingot drawn out from the mold, and the rod-like ingot is continuously drawn out while the solidification of the metal progresses to the inside of the ingot.

In such a horizontal continuous casting, a lubricant is injected into the inner peripheral wall on the inlet side (one end side) of the mold from the supply pipe to prevent seizure of the molten metal on the inner peripheral wall of the hollow portion of the mold (see, for example, Japanese Unexamined Patent Application, First Publication No. H11-170009). In the horizontal continuous casting, the amount of lubricant supplied from the supply pipe is increased to prevent seizure, especially in an alloy that tends to cause seizure, for example, an aluminum alloy containing Mg.

In horizontal continuous casting, the difference in gravity between the upper and lower surfaces of the ingot pushes the lubricant from the lower wall of the inner wall of the mold to the upper wall thereof. The decomposition gas generated by heating the lubricant also rises to the upper wall surface. Therefore, when a large amount of lubricant for preventing seizure is supplied, the excessively vaporized gas of the lubricant stays on the upper wall surface of the mold and prevents heat extraction of the molten metal and the mold.

This causes a difference in the cooling state between the upper part and the lower part of the ingot, resulting in a large vertical difference in the alloy structure of the ingot. When the vertical difference in the alloy structure becomes large, there is a concern that a vertical difference in the mechanical strength occurs in comparison with the ingot of uniform alloy structure. Further, a large amount of retained lubricant gas and the molten metal may contact and react, and reaction products, for example, carbides, may be entrained on the surface of the ingot. In this case, the cutting margin on the surface of the ingot is increased, and the ingot that cannot be used as a product is likely to occur.

SUMMARY OF THE INVENTION

In order to investigate the cause of the need for a large amount of lubricant, the inventors measured the temperature of the area facing the inner bottom surface of the cooling water cavity among the inner peripheral surface where the molten alloy was in contact with the hollow portion of the mold. As a result, it was confirmed that the wall surface temperature of this area was 180 to 200° C. When the amount of lubricant was reduced in this temperature range, the solidified ingot of the molten alloy was subjected to seizure. Therefore, in order to properly exchange heat between the inner peripheral surface of the hollow portion of the mold and the inner bottom surface of the cooling water cavity, a new knowledge was obtained that seizure can be prevented by setting the heat flux value in this region to a specific range.

A first aspect of the present disclosure provides a horizontal continuous casting apparatus, in which molten aluminum alloy in a molten metal receiving portion of a hollow mold is supplied from one end side of the mold to a hollow portion of the mold, of which the central axis of the hollow portion is arranged along the horizontal direction, to manufacture an aluminum alloy cast rod, including a fluid supply pipe for supplying a lubricating fluid to the hollow portion of the mold, which is arranged on one end side of the mold, and a cooling water cavity for accommodating cooling water cooling an inner peripheral surface of the hollow portion of the mold, which is formed outside the inner peripheral surface, wherein the inner peripheral surface and the inner bottom surface of the cooling water cavity facing the inner peripheral surface form parallel surfaces with each other, and a cooling wall of the mold between the inner peripheral surface and the inner bottom surface is formed so that the heat flux value per unit area from the molten aluminum alloy to the cooling water is $10\times10^5$ W/m$^2$ or more.

According to the present disclosure, even in the case of casting an aluminum alloy having a composition in which seizure is likely to occur during casting, the occurrence of lubricant reaction products can be reliably suppressed and an aluminum alloy cast rod with good quality can be manufactured by setting the heat flux value per unit area of the cooling wall of the mold, where the inner bottom surface of the cooling water cavity and the inner peripheral surface of the hollow portion of the mold face each other, to $10\times10^5$ W/m$^2$ or more.

In the horizontal continuous casting apparatus according to the above aspect, the heat flux value may be $10\times10^5$ W/m$^2$ or less.

In the horizontal continuous casting apparatus according to the above aspect, the thickness of the cooling wall of the mold may be in the range of 0.5 mm or more and 3.0 mm or less.

The horizontal continuous casting apparatus according to the above aspect may include a cooling water injection passage for communicating the cooling water cavity with the hollow portion of the mold.

The horizontal continuous casting apparatus according to the above aspect may include a heat insulating member which is arranged between the molten metal receiving portion and the end side of the mold.

In the horizontal continuous casting apparatus according to the above aspect, the molten aluminum alloy may have a magnesium content of 0.5 mass % or more.

In the horizontal continuous casting apparatus according to the above aspect, the molten aluminum alloy may contain Si (content: 0.05 to 1.3 mass %), Fe (content: 0.1 to 0.7 mass %), and Cu (content: 0.1 to 2.5% mass). %), Mn (content: 0.05 to 1.1 mass %), Mg (content: 0.8 to 3.5 mass %), Cr (content: 0.04 to 0.4 mass %), and Zn (content: 0.05 to 8.0 mass % or less).

A second aspect of the present disclosure provides a method of manufacturing an aluminum alloy cast rod using a horizontal continuous casting apparatus according to the first aspect of the present disclosure, wherein the molten alloy is continuously supplied from one end side of the mold to the hollow portion, cooling water is supplied to the cooling water cavity, and the molten alloy is cooled and solidified under a condition that a heat flux value per unit area in the cooling wall is $10\times10^5$ W/m$^2$ or more to manufacture the aluminum alloy cast rod.

DETAILED DESCRIPTION OF THE INVENTION

Figure 1:
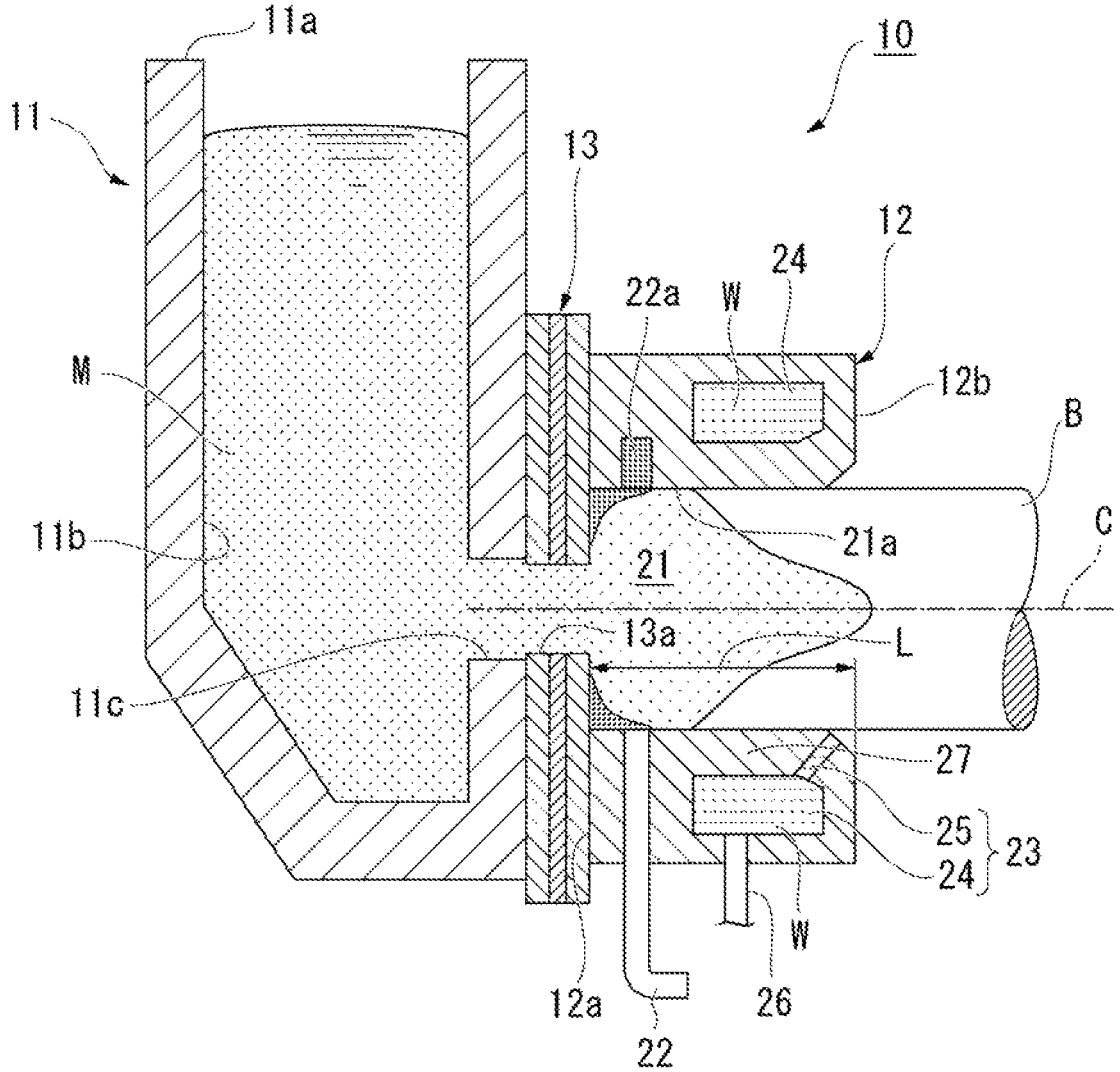
FIG. 1 is a schematic cross-sectional view of a main part showing an example of the vicinity of a mold of the horizontal continuous casting apparatus of the present disclosure.

A horizontal continuous casting apparatus according to one embodiment of the present disclosure will now be described with reference to the drawings. It should be noted that the following embodiments are specifically described in order to provide a better understanding of the object of the disclosure, and are not intended to limit the disclosure unless otherwise specified. Further, in the drawings used in the following description, for the sake of clarity of the features of the present disclosure, there are cases where the essential parts are enlarged for the sake of convenience, and it is not always the case that the dimension ratio of each component or the like is the same as the actual one.

First, an example of an aluminum alloy cast rod produced by the horizontal continuous casting apparatus of this embodiment will be described. The aluminum alloy cast rod is manufactured by a horizontal continuous casting method using a hollow cylindrical mold with a central axis held approximately horizontal ("approximately horizontal" means the lateral direction) and provided with a cooling means. The aluminum alloy cast rod may have a diameter of, for example, 10 mm to 100 mm.

Although the aluminum alloy cast rod can be used in a range other than the diameter range described above, it is preferable that the diameter be in the range of 10 mm to 100 mm in order to reduce the scale and cost of the equipment for the plastic working in the post-process, for example, forging, roll forging, drawing, rolling and impact working. In the case of casting with a different diameter, the diameter can be changed to a detachable cylindrical mold having an inner diameter corresponding to the diameter, and the melt temperature and casting speed can be changed accordingly. The setting of the amount of cooling water and the amount of lubricant may be changed as necessary.

The aluminum alloy cast rod is used as a material for plastic working in a subsequent process, for example, forging, roll forging, drawing, rolling and impact working. Alternatively, it can be used as a material for machining such as bar machining or drilling.

Next, a horizontal continuous casting apparatus according to one embodiment of the present disclosure will be described.

FIG. 1 is a cross-sectional view showing an example of the vicinity of a mold of the horizontal continuous casting apparatus of the present disclosure.

The horizontal continuous casting apparatus 10 of this embodiment includes a molten metal receiving portion (tundish) 11, a hollow cylindrical mold 12, and a refractory plate-like body (heat insulating member) 13 disposed between one end side 12*a* of the mold 12 and the molten metal receiving portion 11.

The molten metal receiving portion 11 includes a molten metal inlet 11*a* for receiving a molten aluminum alloy (hereinafter referred to as molten alloy) M adjusted to a prescribed alloy component by an external melting furnace or the like, a molten metal holding portion 11*b*, and an outlet 11*c* to the hollow portion 21 of the mold 12. The molten metal receiving portion 11 maintains the level of the upper liquid surface of the molten alloy M at a position higher than the upper surface of the hollow portion 21 of the mold 12, and stably distributes the molten alloy M to the respective molds 12 in the case of multiple casting.

The molten alloy M held by the molten metal holding portion 11*b* in the molten metal receiving portion 11 is poured into the hollow 10 portion 21 of the mold 12 from a pouring passage 13*a* provided in the refractory plate-like body 13. The molten alloy M supplied into the hollow portion 21 is cooled and solidified by a cooling device 23 to be described later, and is drawn out from the other end side 12*b* of the mold 12 as an aluminum alloy cast rod B which is a solidified ingot.

On the other end side 12*b* of the mold 12, there may be provided a pull-out driving device (not shown) for pulling out the aluminum alloy cast rod B at a constant speed. It is also preferable that a synchronous cutter (not shown) for cutting the continuously drawn aluminum alloy cast rod B to an arbitrary length is provided.

The refractory plate-like body 13 is a member that blocks heat transfer between the molten metal receiving portion 11 and the mold 12, and may be made of a material such as calcium silicate, alumina, silica, a mixture of alumina and silica, silicon nitride, silicon carbide, graphite, or the like. The refractory plate-like body 13 may be composed of a plurality of layers of mutually different constituent materials.

The mold 12 is a hollow cylindrical member in the present embodiment, and is formed of one or a combination of two or more materials selected from, for example, aluminum, copper, or alloys thereof. For the material of the mold 12, the optimum combination may be selected from the viewpoint of thermal conductivity, heat resistance, and mechanical strength.

The hollow part 21 of the mold 12 is formed to have a circular cross section in order to make the aluminum alloy cast rod B to be cast into a cylindrical rod shape. The mold 12 is held so that the mold center axis (center axis) C passing through the center of the hollow part 21 is substantially along the horizontal direction.

The inner peripheral surface 21*a* of the hollow portion 21 of the mold 12 is formed at an elevation angle of 0° to 3° (more preferably 0° to 1°) with respect to the mold central axis C in the drawing direction of the aluminum alloy cast rod B. That is, the inner peripheral surface 21*a* is formed in a tapered shape that opens like a cone toward the drawing direction. The angle formed by the taper is an elevation angle.

When the elevation angle is less than 0°, the aluminum alloy cast rod B receives resistance at the other end side 12*b* as the mold outlet when it is pulled out from the mold 12, so that casting becomes difficult. On the other hand, when the elevation angle exceeds 3°, the contact of the inner peripheral surface 21*a* with the molten alloy M becomes insufficient. For this, there is a concern that solidification may be insufficient because the heat extraction effect from the molten alloy M or the solidified shell in which the molten alloy M is cooled and solidified to the mold 12 decreases. As a result, there is a high possibility that a remelted surface will occur on the surface of the aluminum alloy cast rod B, or that unsolidified alloy molten metal M will be ejected from the end of the aluminum alloy cast rod B, which is not preferable because it is more likely to lead to casting trouble.

The cross-sectional shape of the hollow portion 21 of the mold 12 (the planar shape when the hollow portion 21 of the mold 12 is viewed from the other end side 12*b*) may be selected according to the shape of the aluminum alloy cast rod to be cast, such as a triangular or rectangular cross-sectional shape, a polygonal shape, a semicircular shape, an ellipse shape, a shape having a deformed cross-sectional shape having no axis or plane of symmetry, in addition to the circular shape of the present embodiment.

A fluid supply pipe 22 for supplying lubricating fluid into the hollow portion 21 of the mold 12 is disposed on one end side 12*a* of the mold 12. The lubricating fluid supplied from the fluid supply pipe 22 may be one or more lubricating fluids selected from a gas lubricant and a liquid lubricant. When both the gas lubricant and the liquid lubricant are supplied, it is preferable to provide the fluid supply tubes separately. The lubricating fluid supplied under pressure from the fluid supply pipe 22 is supplied into the hollow portion 21 of the mold 12 through the annular lubricant supply port 22*a*.

In this embodiment, the pressure-fed lubricating fluid is supplied from the lubricant supply port 22*a* to the inner peripheral surface 21*a* of the mold 12. The liquid lubricant may be heated to form a decomposed gas and supplied to the inner peripheral surface 21*a* of the mold 12. Further, a porous material may be disposed at the lubricant supply port 22*a*, and lubricating fluid may be exuded to the inner peripheral surface 21*a* of the mold 12 through the porous material.

A cooling device 23 as a cooling means for cooling and solidifying the molten alloy M is formed inside the mold 12. The cooling device 23 of the present embodiment includes a cooling water cavity 24 for containing cooling water W for cooling the inner peripheral surface 21*a* of the hollow portion 21 of the mold 12, and a cooling water injection passage 25 for communicating the cooling water cavity 24 with the hollow portion 21 of the mold 12.

The cooling water cavity 24 is annularly formed inside the mold 12 and outside the inner peripheral surface 21*a* of the hollow portion 21 so as to surround the hollow portion 21, and the cooling water W is supplied through the cooling water supply pipe 26.

When the inner peripheral surface 21*a* is cooled by the cooling water W accommodated in the cooling water cavity 24, the mold 12 removes the heat of the molten alloy M filled in the hollow portion 21 of the mold 12 from the surface of the molten alloy M in contact with the inner peripheral surface 21*a* of the mold 12 to form a solidified shell on the surface of the molten alloy M.

The cooling water injection passage 25 cools the aluminum alloy cast rod B by directly applying cooling water to the aluminum alloy cast rod B at the other end 12*b* of the mold 12 from the shower opening 25*a* facing the hollow part 21. The longitudinal sectional shape of the cooling water injection passage 25 may be, for example, a semicircle, a pear shape or a horseshoe shape in addition to the circular shape of the present embodiment.

In the present embodiment, the cooling water W supplied through the cooling water supply pipe 26 is first accommodated in the cooling water cavity 24 to cool the inner peripheral surface 21*a* of the hollow portion 21 of the mold 12, and the cooling water W of the cooling water cavity 24 is injected from the cooling water injection passage 25 toward the aluminum alloy cast rod B.

The length from the position where the extension line of the central axis of the shower opening 25*a* of the cooling water injection passage 25 strikes the surface of the cast aluminum alloy rod B to the contact surface between the mold 12 and the refractory platelike body 13 is referred to as the effective mold length L, and the effective mold length L is preferably, for example, 10 mm to 40 mm. When the effective mold length L is less than 10 mm, casting is not possible because a good film is not formed or for other reasons. When the effective mold length L is more than 40 mm, the effect of forced cooling is no effective, solidification by the mold wall becomes dominant, contact resistance between the mold 12 and the molten alloy M or the aluminum alloy cast rod B becomes large, and cracking occurs on the casting surface, and casting becomes unstable, which is undesirable. When the effective mold length L is more than 40 mm, there is no effect of forced cooling, solidification by the mold wall becomes dominant, contact resistance between the mold 12 and the molten alloy M or the aluminum alloy casting rod B increases, and as a result, the casting surface thereof may be cracked or the molten alloy M or the aluminum alloy casting rod B may be torn off inside the mold, leading to unstable casting.

It is preferable that the operation of the cooling water supply to the cooling water cavity 24 and the cooling water injection from the shower opening 25*a* of the cooling water injection passage 25 can be controlled by a control signal from a controller (not shown).

The cooling water cavity 24 is formed such that the inner bottom surface 24*a* of the mold 12 near the hollow portion 21 is parallel to the inner peripheral surface 21*a* of the hollow portion 21 of the mold 12. The term "parallel" here also includes a case where the inner peripheral surface 21*a* of the hollow portion 21 of the mold 12 is formed at an elevation angle of 0° to 3° with respect to the inner bottom surface 24*a* of the cooling water cavity 24, that is, the inner bottom surface 24*a* is inclined at an angle of more than 0° to 3° with respect to the inner peripheral surface 21*a*.

Figure 2:
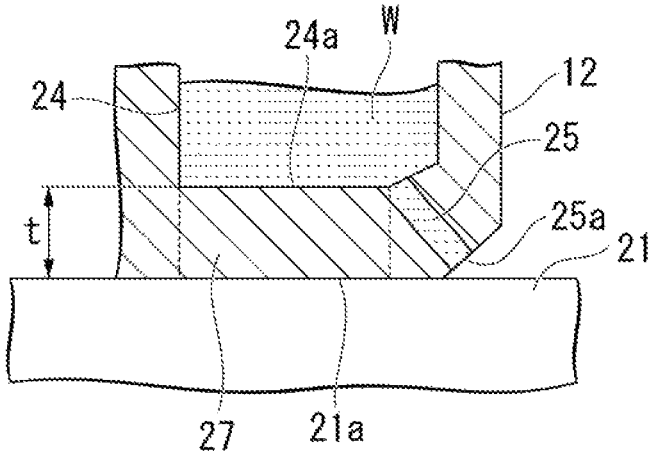
FIG. 2 is an enlarged cross-sectional view of a main part showing the vicinity of the cooling water cavity shown in FIG. 1.

As shown in FIG. 2, the cooling wall 27 of the mold 12, which is a portion where the inner bottom surface 24*a* of the cooling water cavity 24 and the inner peripheral surface 21*a* of the hollow portion 21 of the mold 12 face each other, is formed so that the heat flux value per unit area from the molten alloy M of the hollow portion 21 toward the cooling water W of the cooling water cavity 24 is in the range of $10\times10^5$ W/m$^2$ or more and $50\times10^5$ W/m$^2$ or less.

The mold 12 may be formed such that the thickness t of the cooling wall 27 of the mold 12, that is, the distance between the inner bottom surface 24*a* of the cooling water cavity 24 and the inner peripheral surface 21*a* of the hollow portion 21 of the mold 12, is in a range of, for example, from 0.5 mm to 3.0 mm, preferably from 0.5 mm to 2.5 mm. Further, the material for forming the mold 12 may be selected so that the thermal conductivity of at least the cooling wall 27 of the mold 12 is in the range of 100 W/m·K or more and 400 W/m·K or less.

The operation of the horizontal continuous casting apparatus of the present disclosure will be described.

In FIG. 1, the molten alloy M in the molten metal receiving portion 11 is supplied from one end side 12*a* of the mold 12, which is held through the refractory plate-like body 13 so that the central axis C of the mold is substantially horizontal, and is forcibly cooled at the other end side 12*b* of the mold 12 to form the aluminum alloy cast rod B. Since the aluminum alloy cast rod B is drawn out at a constant speed by a drawing driving device (not shown) installed near the other end side 12*b* of the mold 12, the aluminum alloy cast rod B is continuously cast to form a long aluminum alloy cast rod B. The extracted aluminum alloy casting rod B is cut to a desired length by, for example, a tuning cutter (not shown).

The composition of the molten alloy M of the aluminum alloy stored in the molten metal receiving portion 11 includes, for example, Si (content: 0.05~1.3 mass %), Fe (content: 0.10~0.70 mass %), Cu (content: 0.1~2.5 mass %), Mn (content: 0.05~1.1 mass %), Mg (content: 0.5~3.5 mass %), Cr (content: 0.04~0.4 mass %), and Zn (content: 0.05~8.0 mass % or less). The content of Mg is preferably 0.8~3.5 mass %.

The composition ratio of the aluminum alloy cast rod B can be confirmed by, for example, a method using a photoelectrophotometric emission spectrophotometer (apparatus example: PDA-5500 manufactured by Japan Shimadzu Corporation) as described in JIS H 1305.

The difference between the height of the liquid level of the molten alloy M stored in the molten metal receiving portion 11 and the height of the inner peripheral surface 21*a* on the upper side of the mold 12 is preferably 0 mm to 250 mm (more preferably 50 mm to 170 mm). In such a range, the pressure of the molten alloy M supplied into the mold 12 and the lubricant and the gas in which the lubricant is vaporized are suitably balanced, thereby stabilizing castability.

As the liquid lubricant, vegetable oil as a lubricant can be used. For example, rapeseed oil, castor oil and vegetable oil can be cited. These are preferable because they have little adverse effect on the environment.

The lubricant supply is preferably from 0.05 mL/min to 5 mL/min (more preferably 0.1 mL/min to 1 mL/min.). If the supply amount is too small, the molten alloy of the aluminum alloy casting rod B may leak from the mold without solidifying due to insufficient lubrication. If the supply amount is excessive, the surplus may be mixed into the aluminum alloy casting rod B and cause internal defects.

The casting speed, which is the rate at which the aluminum alloy casting rod B is withdrawn from the mold 12, is preferably from 200 mm/min to 1500 mm/min (more preferably 400 mm/min to 1000 mm/min.). This is because, if the casting speed is in this range, the network structure of the crystallized product formed in the casting becomes uniform and fine, the resistance to deformation of the aluminum fabric under high temperature increases, and the high temperature mechanical strength improves.

The amount of cooling water injected from the shower opening 25*a* of the cooling water injection passage 25 is preferably from 10 L/min to 50 L/min per mold (more preferably 25 L/min to 40 L/min.). If the amount of cooling water is smaller than this range, the molten alloy may leak from the mold without solidifying. Further, the surface of the cast aluminum alloy cast rod B is remelted to form a non-uniform structure, which may remain as an internal defect. On the other hand, when the amount of cooling water is larger than this range, there is a possibility that heat extraction of the mold 12 is too large and solidifies in the middle.

The average temperature of the molten alloy M flowing into the mold 12 from the molten metal receiving portion 11 is preferably, for example, 650° C. to 750° C. (more preferably 680° C. to 720° C.). If the temperature of the molten alloy M is too low, coarse crystallized material are formed in the mold 12 and in front of the mold 12, and is taken into the aluminum alloy casting rod B as an internal defect. On the other hand, if the temperature of the molten alloy M is too high, a large amount of hydrogen gas is easily taken into the molten alloy M, and may be taken into the aluminum alloy casting rod B as porosity, resulting in an internal cavity.

In the cooling wall 27 of the mold 12, as in the present embodiment, the heat flux value per unit area from the molten alloy M of the hollow portion 21 to the cooling water W of the cooling water cavity 24 is set in the range of $10\times10^5$ W/m$^2$ or more and $50\times10^5$ W/m$^2$ or less, thereby preventing the aluminum alloy casting rod B from seizure.

Figure 3:
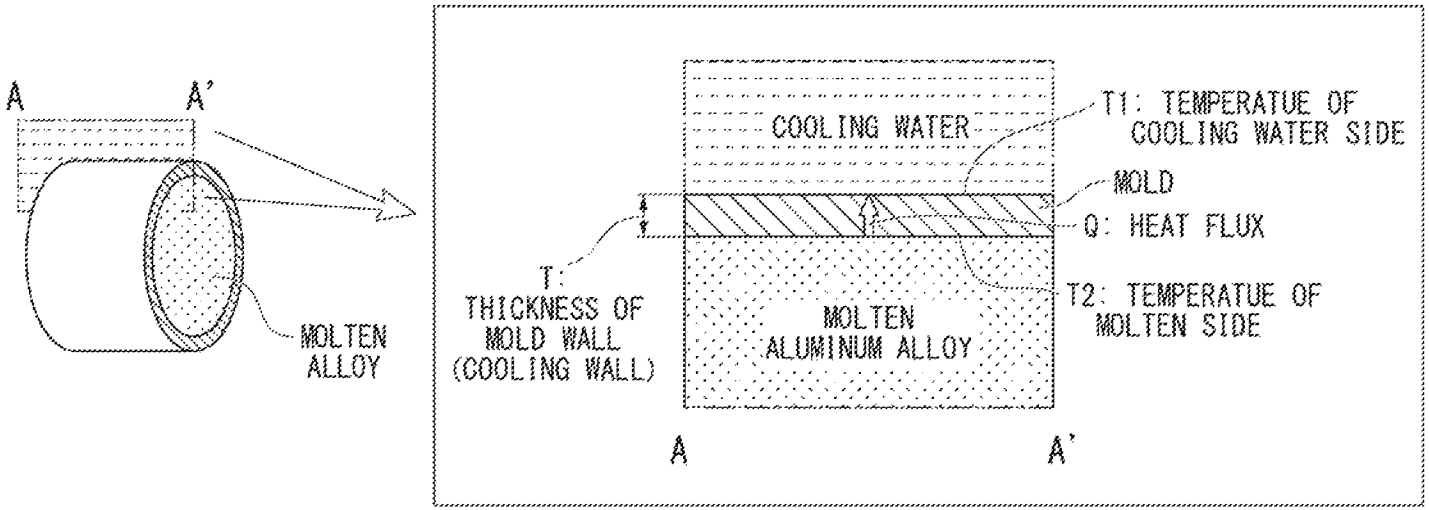
FIG. 3 is an explanatory diagram illustrating the heat flux of the cooling wall according to the present disclosure.

The cooling wall 27 of the mold 12 receives heat by heat extraction from the molten alloy M, and performs heat exchange by cooling the heat with cooling water W stored in the cooling water cavity 24. As shown in the explanatory diagram of FIG. 3, attention was paid to the heat flux per unit area.

The heat flux per unit area is expressed by the following equation (1) according to Fourier's law.

$$Q=-k\times\{(T1-T2)/L\} \quad (1)$$

Q: Heat Flux k: thermal conductivity (W/m·K) of the portion where heat passes (cooling wall 27 of mold 12 in this embodiment)

T1: the cold-side temperature at which heat passes (in this embodiment, the inner bottom surface 24*a* of the cooling water cavity 24)

T2: the high-temperature side temperature at which heat passes (in this embodiment, the inner peripheral surface 21*a* of the hollow portion 21 of the mold 12)

L: section length (mm) at which heat passes (in this embodiment, thickness t of the cooling wall 27 of the mold 12)

The cooling wall part 27 of the mold 12 is constituted so that the heat flux value per unit area is $10\times10^5$ W/m$^2$ or more based on the mold material, the thickness and the temperature measurement data obtained by obtaining a good result even if the amount of lubricant is reduced during casting, thereby preventing the cast aluminum alloy casting rod B from seizure. The heat flux value per unit area is preferably $50\times10^5$ W/m$^2$ or less.

In order to make the cooling wall 27 of the mold 12 in the range of such a heat flux value, the mold 12 may be formed so that the thickness t of the cooling wall 27 of the mold 12 is in the range of, for example, 0.5 mm or more and 3.0 mm or less. The thermal conductivity of at least the cooling wall 27 of the mold 12 may be set in a range of 100 W/m·K or more and 400 W/m·K or less.

In the method of manufacturing an aluminum alloy cast rod according to an embodiment of the present disclosure, the molten alloy M stored in the molten metal receiving portion 11 is continuously supplied into the hollow portion 21 from one end side 12*a* of the mold 12 by using the horizontal continuous casting apparatus described above. Further, cooling water W is supplied to the cooling water cavity 24, and lubricating fluid such as lubricant is supplied from the fluid supply pipe 22.

The molten alloy M supplied into the hollow part 21 is cooled and solidified under the condition that the heat flux value per unit area in the cooling wall part 27 is $10\times10^5$ W/m$^2$ or more to cast the aluminum alloy cast rod B. At the time of casting the aluminum alloy cast rod B, the wall surface temperature of the cooling wall 27 of the mold 12 cooled by the cooling water W is preferably set to 100° C. or less.

The aluminum alloy casting rod B thus obtained is cooled and solidified under the condition that the heat flux value per unit area in the cooling wall 27 is $10\times10^5$ W/m$^2$ or more, whereby the adhesion of reaction products, for example, carbides, due to the contact between the gas of the lubricant and the molten alloy M, is suppressed. Thus, the aluminum alloy cast rod B can be manufactured in a high yield without cutting and removing carbides or the like on the surface of the aluminum alloy cast rod B.

As described above, according to the horizontal continuous casting apparatus of the present embodiment and the method of manufacturing the aluminum alloy cast rod using the same, the aluminum alloy cast rod B with good quality can be manufactured by surely suppressing the generation of lubricant reaction products even in the casting of an aluminum alloy, for example, an aluminum alloy containing 0.5 mass % or more (preferably 0.8 mass % or more) of magnesium, which tends to cause seizure at the time of casting, by setting the heat flux value per unit area of the cooling wall 27 of the mold 12 at $10\times10^5$ W/m$^2$ or more where the inner bottom surface 24*a* of the cooling water cavity 24 and the inner peripheral surface 21*a* of the hollow portion 21 of the mold 12 face each other.

Although the embodiments of the present disclosure have been described above, these embodiments have been presented as examples and are not intended to limit the scope of the disclosure. Such embodiments may be implemented in various other ways, and various omissions, substitutions, and modifications may be made without departing from the spirit of the disclosure. These embodiments and variations thereof are included in the scope and the gist of the disclosure as well as in the same scope as the disclosure described in the claims.

EXAMPLES

The effect of the present disclosure was verified.

In the verification, a horizontal continuous casting apparatus 10 having the structure shown in FIG. 1 was used to calculate the heat flux per unit area of each cooling wall part 27 under the conditions of the constituent material of the mold 12, Example 1~4 in which the thickness of the cooling wall part 27 was changed, and Comparative Examples 1 and 2, and to visually confirm the presence or absence of seizure of the cast aluminum alloy cast rod B. As the molten alloy, an aluminum alloy containing 0.5 mass % of magnesium was used.

The results of these tests are shown in Table 1.

TABLE 1

| | Material of Mold | Thickness of Cooling Wall | Temperature 1 (*1) | Temperature 2 (*2) | Heat Flux (W/m$^2$) | Seizure |
|---|---|---|---|---|---|---|
| Example 1 | Cu (*3) | 2 mm | 100° C. | 700° C. | $11.7\times10^5$ | none |
| Example 2 | graphite(porosity) | 0.5 mm | 100° C. | 700° C. | $10.8\times10^5$ | none |
| Example 3 | Cu (*3) | 0.5 mm | 70° C. | 700° C. | $49.2\times10^5$ | none |
| Example 4 | Al | 1.3 mm | 100° C. | 700° C. | $10.4\times10^5$ | none |
| Comparative Example 1 | Cu (*3) | 3.5 mm | 180° C. | 700° C. | $5.9\times10^4$ | yes |
| Comparative Example 2 | graphite(porosity) | 3.5 mm | 190° C. | 700° C. | $1.57\times10^4$ | yes |

*1: Temperature of inner bottom surface of cooling water cavity

*2: Temperature of inner surface area of mold cavity facing inner bottom surface of the cooling water cavity

*3: C 1100 (copper with purity of 99.9% or more as specified in JIS H 3100 (Tough Pitch Copper))

According to the results shown in Table 1, it was confirmed that by setting the thickness of the cooling wall 27 to 0.5 mm to 2 mm and setting the heat flux per unit area of the cooling wall 27 to $10\times10^5$ W/m$^2$ or more, the occurrence of seizure of the cast aluminum alloy rod B could be prevented.

What is claimed is:

1. A horizontal continuous casting apparatus, in which molten aluminum alloy in a molten metal receiving portion of a hollow mold is supplied from one end side of the mold to a hollow portion of the mold, of which the central axis of the hollow portion is arranged along a horizontal direction, to manufacture an aluminum alloy cast rod, comprising:

a fluid supply pipe for supplying a lubricating fluid to the hollow portion of the mold, which is arranged on one end side of the mold; and, a cooling water cavity for accommodating cooling water cooling an inner peripheral surface of the hollow portion of the mold, which is formed outside the inner peripheral surface:

wherein the inner peripheral surface and an inner bottom surface of the cooling water cavity facing the inner peripheral surface form parallel surfaces with each other, and a cooling wall of the mold between the inner peripheral surface and the inner bottom surface is solid and formed so that a heat flux value per unit area from the molten aluminum alloy to the cooling water is $10\times10^5$ W/m$^2$ or more, wherein the heat flux value per unit area of $10\times10^5$ W/m$^2$ or more is due to the cooling wall of the mold between the inner peripheral surface and the inner bottom surface being solid.

2. The horizontal continuous casting apparatus according to claim 1, wherein the heat flux value per unit area is $10\times10^5$ W/m$^2$ to $50\times10^5$ W/m$^2$.

3. The horizontal continuous casting apparatus according to claim 1, wherein the thickness of the cooling wall of the mold is in the range of 0.5 mm or more and 3.0 mm or less.

4. The horizontal continuous casting apparatus according to claim 1, further comprising a cooling water injection passage for communicating the cooling water cavity with the hollow portion of the mold.

5. The horizontal continuous casting apparatus according to claim 1, further comprising a heat insulating member arranged between the molten metal receiving portion and the one end side of the mold.

6. The horizontal continuous casting apparatus according to claim 1, wherein the molten aluminum alloy has a magnesium content of 0.5 mass % or more.

7. The horizontal continuous casting apparatus according to claim 1, wherein the molten aluminum alloy contains Si (content: 0.05 to 1.3 mass %), Fe (content: 0.1 to 0.7 mass %), Cu (content: 0.1 to 2.5% mass %), Mn (content: 0.05 to 1.1 mass %), Mg (content: 0.8 to 3.5 mass %), Cr (content: 0.04 to 0.4 mass %), and Zn (content: 0.05 to 8.0 mass % or less).

8. The horizontal continuous casting apparatus according to claim 1, wherein the thickness of the cooling wall of the mold is in the range of 0.5 mm or more and 2.5 mm or less.

9. The horizontal continuous casting apparatus according to claim 1, wherein the thickness of the cooling wall of the mold is in the range of 0.5 mm or more and 2 mm or less.

10. The horizontal continuous casting apparatus according to claim 1, wherein the thickness of the cooling wall of the mold is in the range of 0.5 mm or more and 1.3 mm or less.

11. A method of manufacturing an aluminum alloy cast rod using a horizontal continuous casting apparatus according to claim 1, wherein the molten alloy is continuously supplied from one end side of the mold to the hollow portion, cooling water is supplied to the cooling water cavity, and the molten alloy is cooled and solidified under a condition that a heat flux value per unit area in the cooling wall is $10\times10^5$ W/m$^2$ or more to manufacture the aluminum alloy cast rod.

12. The method according to claim 11, wherein the heat flux value per unit area is $10\times10^5$ W/m$^2$ to $50\times10^5$ W/m$^2$.

* * * * *